US012553160B2

(12) United States Patent
Montgomery

(10) Patent No.: US 12,553,160 B2
(45) Date of Patent: Feb. 17, 2026

(54) UPPER TORSO GARMENT WITH VARIED TUCK BINDER KNIT STRUCTURE

(71) Applicant: NIKE, Inc., Beaverton, OR (US)

(72) Inventor: Paul R. Montgomery, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/482,645

(22) Filed: Oct. 6, 2023

(65) Prior Publication Data

US 2024/0032611 A1 Feb. 1, 2024

Related U.S. Application Data

(62) Division of application No. 16/570,746, filed on Sep. 13, 2019, now Pat. No. 11,819,064.

(60) Provisional application No. 62/773,934, filed on Nov. 30, 2018.

(51) Int. Cl.
*A41C 3/00* (2006.01)
*D04B 1/24* (2006.01)

(52) U.S. Cl.
CPC ..... *D04B 1/246* (2013.01); *A41C 3/0014* (2013.01)

(58) Field of Classification Search
CPC ..... D10B 2403/021
See application file for complete search history.

(56) References Cited

U.S. PATENT DOCUMENTS 2,628,357 A 2/1953 Frances
2,899,812 A 8/1959 Attenborough
2,946,211 A 7/1960 Morancy
3,322,120 A 5/1967 Wyss et al.
4,019,350 A 4/1977 Schmidt
4,267,710 A 5/1981 Imamichi
4,356,710 A 11/1982 Mizuno et al.
4,745,917 A 5/1988 Hasty et al.
4,797,311 A 1/1989 Kemp
5,359,865 A 11/1994 So
5,887,451 A * 3/1999 Suzuki ..... D04B 1/246 66/64
6,089,052 A 7/2000 Riegger
6,526,783 B2 3/2003 Sheu
6,612,136 B2 9/2003 Roe
(Continued)

FOREIGN PATENT DOCUMENTS

CN 108437595 A 8/2018
EP 1895036 A1 3/2008
(Continued)

OTHER PUBLICATIONS

Intention to Grant received for European Application No. 19790394.1, mailed on Jan. 19, 2024, 7 pages.
(Continued)

*Primary Examiner* — Jocelyn Bravo

(74) *Attorney, Agent, or Firm* — Shook, Hardy & Bacon L.L.P.

(57) ABSTRACT

An upper-torso garment includes a first knit zone and a second knit zone. The first knit zone includes a knit structure with a single course of tuck binder stitches and having a first amount of flexural rigidity, and the second knit zone includes a knit structure with a plurality of tuck binder courses and having a second amount of flexural rigidity, which is different than the first amount of flexural rigidity.

18 Claims, 9 Drawing Sheets

(56) References Cited

U.S. PATENT DOCUMENTS

| | | | | |
|---|---|---|---|---|
| 6,739,158 | B2 | 5/2004 | Sciacca | |
| 6,779,367 | B2 | 8/2004 | Mitchell et al. | |
| 6,854,296 | B1 | 2/2005 | Miller, III | |
| 6,899,591 | B2 | 5/2005 | Mitchell | |
| 7,051,557 | B2 | 5/2006 | Mitchell et al. | |
| 7,434,423 | B1 | 10/2008 | Reid et al. | |
| 7,441,419 | B1 | 10/2008 | Dollyhite et al. | |
| 7,611,999 | B2 | 11/2009 | Mcmurray | |
| 7,614,256 | B2 | 11/2009 | Mitchell | |
| 8,075,368 | B2 | 12/2011 | Puyaubreau | |
| 8,434,333 | B2 | 5/2013 | Zhang et al. | |
| 8,640,503 | B2 | 2/2014 | Kunde et al. | |
| 8,887,534 | B2 | 11/2014 | Garcia et al. | |
| 9,534,324 | B2 | 1/2017 | Lonati et al. | |
| 9,551,095 | B2 | 1/2017 | Lee | |
| 9,605,365 | B2 | 3/2017 | Platz et al. | |
| 9,636,261 | B2 | 5/2017 | Mitsuno et al. | |
| 10,145,042 | B2 | 12/2018 | Diaz et al. | |
| 10,368,590 | B2 | 8/2019 | Diaz et al. | |
| 11,066,763 | B1 | 7/2021 | Alexander et al. | |
| 11,142,854 | B2 | 10/2021 | Lucas Gaus et al. | |
| 11,174,577 | B2 | 11/2021 | Matsumoto et al. | |
| 2002/0132542 | A1 | 9/2002 | Ratcliffe et al. | |
| 2002/0152775 | A1 | 10/2002 | Browder | |
| 2002/0152776 | A1* | 10/2002 | Didier Laurent | D04B 1/16 66/196 |
| 2004/0097151 | A1 | 5/2004 | Mcmurray | |
| 2004/0099016 | A1* | 5/2004 | Shepherd | D04B 1/18 66/8 |
| 2004/0137822 | A1 | 7/2004 | Mitchell | |
| 2004/0168479 | A1 | 9/2004 | Mcmurray | |
| 2005/0115282 | A1 | 6/2005 | Starbuck | |
| 2009/0275873 | A1 | 11/2009 | Achtelstetter | |
| 2014/0068968 | A1 | 3/2014 | Podhajny et al. | |
| 2015/0128652 | A1 | 5/2015 | Jung | |
| 2015/0173430 | A1 | 6/2015 | Langer et al. | |
| 2016/0353810 | A1* | 12/2016 | Barnes | D04B 1/246 |
| 2017/0029989 | A1 | 2/2017 | Tuscia et al. | |
| 2017/0119063 | A1 | 5/2017 | Diaz et al. | |
| 2018/0177260 | A1 | 6/2018 | Bell et al. | |
| 2018/0317568 | A1 | 11/2018 | Diaz et al. | |
| 2018/0317569 | A1 | 11/2018 | Diaz et al. | |
| 2018/0317570 | A1 | 11/2018 | Diaz et al. | |
| 2018/0320297 | A1 | 11/2018 | Diaz et al. | |
| 2019/0231021 | A1 | 8/2019 | Hoying et al. | |
| 2019/0309452 | A1 | 10/2019 | Liao et al. | |
| 2020/0109496 | A1 | 4/2020 | Lucas et al. | |
| 2020/0170310 | A1 | 6/2020 | Montgomery | |
| 2020/0170387 | A1* | 6/2020 | Heston | A45C 7/009 |
| 2020/0179176 | A1 | 6/2020 | Lechner | |
| 2021/0037919 | A1 | 2/2021 | Tamm et al. | |
| 2021/0071326 | A1 | 3/2021 | Tibbits et al. | |
| 2021/0355613 | A1 | 11/2021 | Dion et al. | |

FOREIGN PATENT DOCUMENTS

| | | | | |
|---|---|---|---|---|
| GB | 1030674 | A | * | 5/1966 |
| GB | 1355351 | A | | 6/1974 |
| TW | M422359 | U | | 2/2012 |
| WO | 2016/197051 | A1 | | 12/2016 |

OTHER PUBLICATIONS

Notice of Allowance received for Canadian Patent Application No. 3115231, mailed on May 27, 2024, 1 page.

Bruer et al., "Three-Dimensionally Knit Spacer Fabrics: A Review of Production Techniques and Applications", Journal of Textile and Apparel, Technology and Management, vol. 4, Issue 4, 2005, 31 pages.

Liu et al., "Compression Property and Air Permeability of Weft-knitted Spacer Fabrics", Journal of the Textile Institute, vol. 102, No. 4, 2011, pp. 366-372.

Liu et al., "Impact of Weft Laid-in Structural Knitting Design on Fabric Tension Behavior and Interfacial Pressure Performance of Circular Knits", Journal of Engineered Fibers and Fabrics, vol. 8, 2013, pp. 96-107.

Sang et al., "Knit Structure and Properties of High Stretch Compression Garments", Textile Science and Engineering, vol. 50, No. 6, 2013, pp. 359-365.

Sang et al., "Structural Effect of Polyester SCY Knitted Fabric on Fabric Size, Stretch Properties, and Clothing Pressure", Fashion and Textiles, vol. 2, No. 22, 2015, 9 pages.

* cited by examiner

UPPER TORSO GARMENT WITH VARIED TUCK BINDER KNIT STRUCTURE

CROSS-REFERENCE TO RELATED APPLICATIONS

This application is a divisional of U.S. patent application Ser. No. 16/570,746 (filed Sep. 13, 2019), which claims the benefit of priority of U.S. Provisional Application No. 62/773,934 (filed on Nov. 30, 2018). The entirety of each of the aforementioned applications is incorporated by reference herein.

FIELD OF THE INVENTION

The present disclosure relates to an upper-torso garment, at least a portion of which includes separate knit zones with different amounts of tuck binder courses.

BACKGROUND

Upper-torso garments typically include various parts configured to cover an upper-torso region of a wearer. For example, upper-torso garments often include a chest-covering portion and a back-covering portion. In addition, upper-torso garments may include various textiles and material types, which are sometimes selected based on various properties. An example of one type of textile that may have various properties and that may be used to construct at least part of an upper-torso garment is a knit textile.

BRIEF DESCRIPTION OF THE DRAWINGS

The subject matter of this disclosure is described in detail herein with reference to the attached figures, which are incorporated herein by reference.

DETAILED DESCRIPTION

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, this disclosure describes an upper-torso garment having various elements that contribute to the operation of the article, both independently of, and in combination with, one another. For example, the upper-torso garment includes one or more portions constructed of a knit structure with varying amounts of tuck binder courses. In an aspect of the disclosure, the amount and location of tuck binder courses in the knit structure affect the properties of the upper-torso garment. Other elements may also affect the properties of the garment, including (but not limited to) the yarn composition and size, additional knit structures, and stitch size, which will be described in more detail in other parts of this disclosure. Among other things, the knit structure with varying amounts of tuck binder courses and other elements may contribute to a fit and shape of the garment, as well as to textile properties, such as flexural rigidity, elongation, compression, breathability, elasticity, stability, support, and the like.

Figure 1:
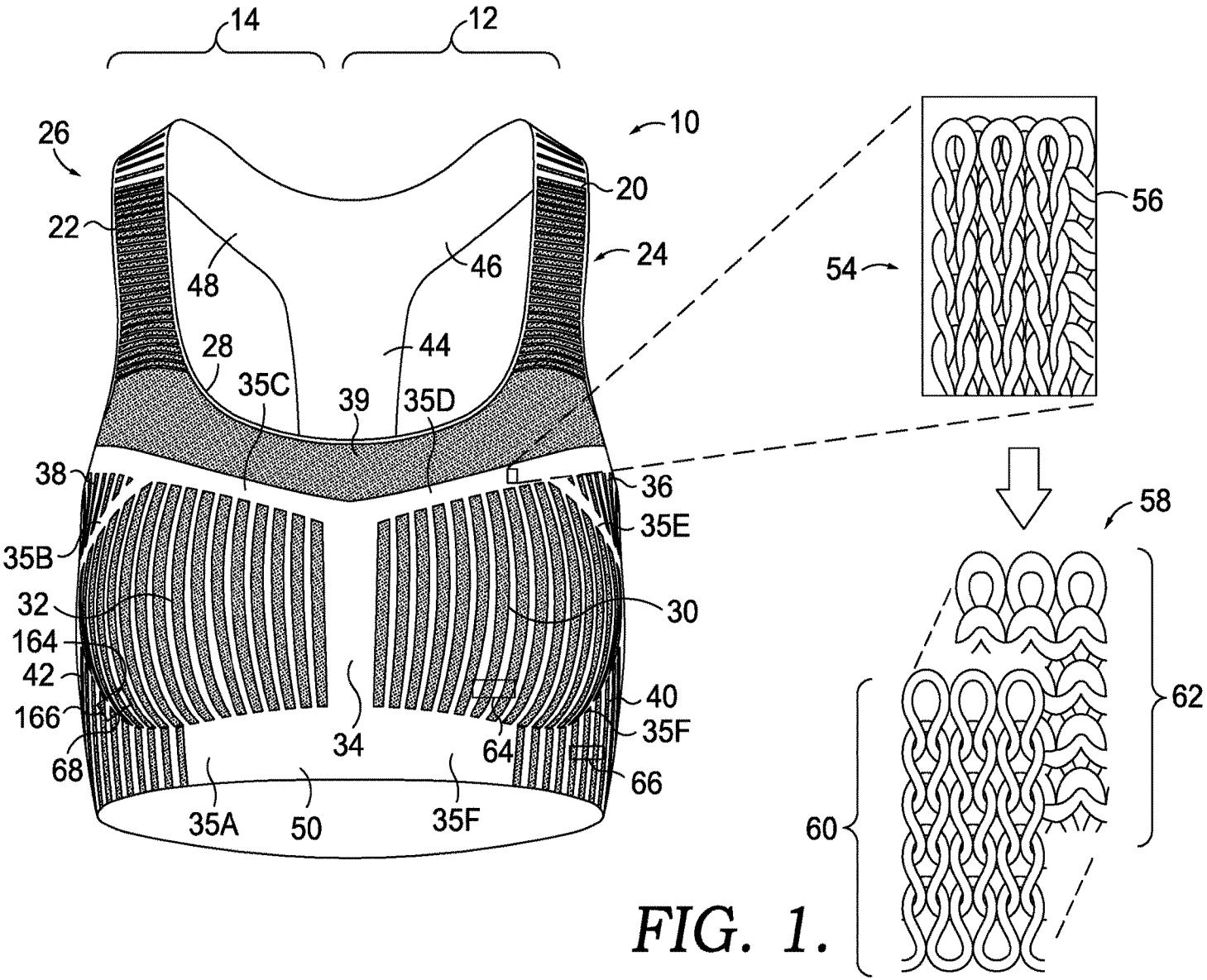
FIG. 1 depicts a front view of an upper-torso garment in accordance with an aspect of this disclosure.
Figure 3:
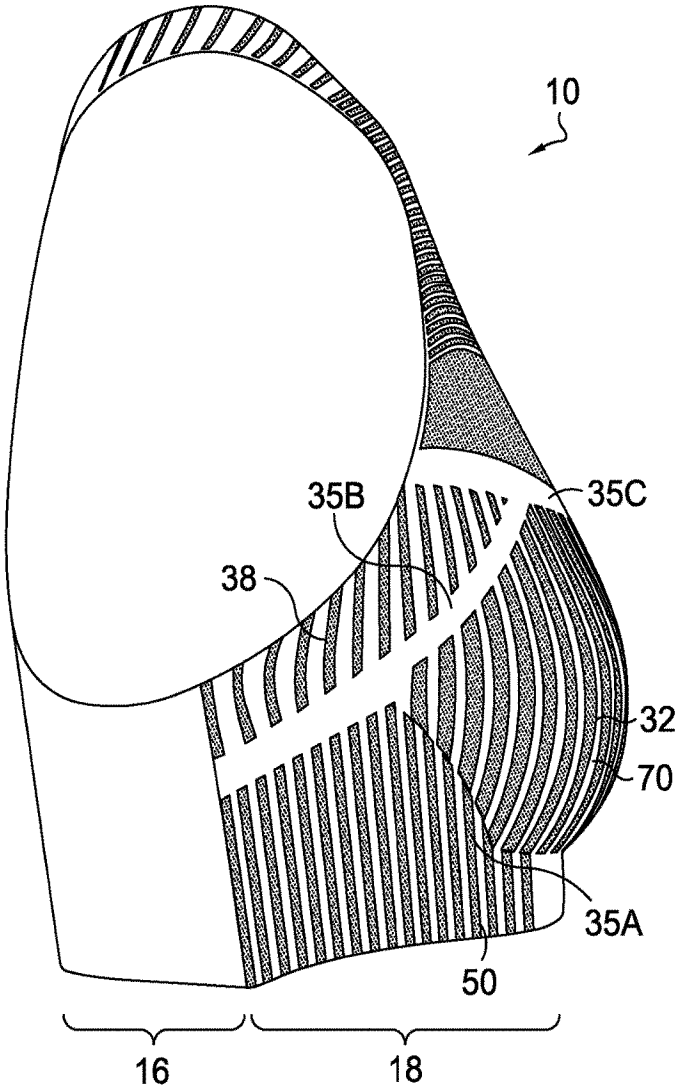
FIG. 3 depicts a side view of the garment depicted in FIG. 1.
Figure 2:
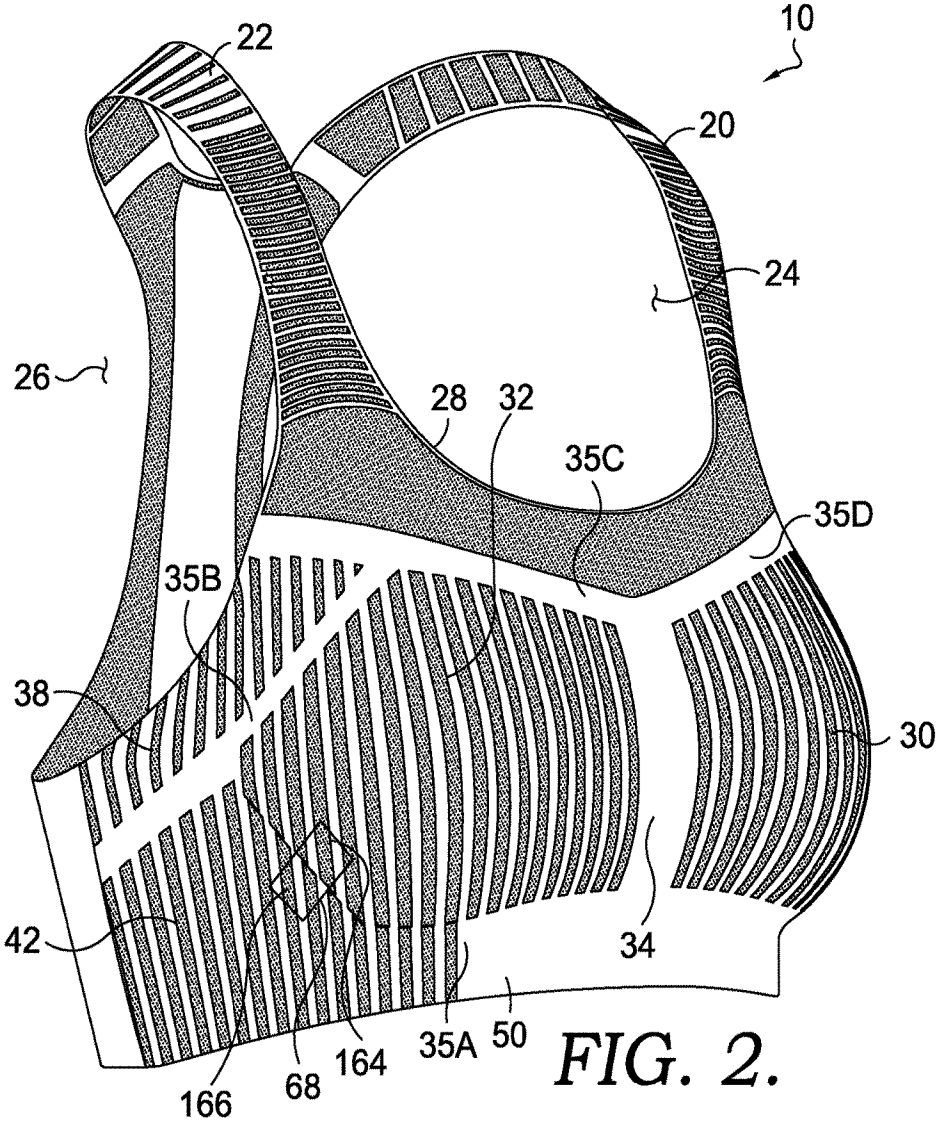
FIG. 2 depicts a front perspective view of the garment depicted in FIG. 1.

Referring initially to FIGS. 1-3, an example of an upper-torso garment 10 is depicted, and in this description, "upper-torso garment" describes any garment configured to cover an upper-torso of a wearer. The illustrated example of the upper-torso garment 10 is a bra, and the style of bra depicted is sometimes referred to as a sports bra, athletic bra, or other similar designation. And in other aspects of this disclosure, an upper-torso garment may include various other types of garments for a female or male, including a strapless bra, a camisole, a base-layer shirt, a singlet, a racing suit, and the like.

When describing various aspects of the upper-torso garment 10, relative terms may be used to aid in understanding relative positions. For instance, as is shown in FIG. 1, the upper-torso garment 10 is divided into a left side 12 and a right side 14. In addition, as is shown in FIG. 3, which depicts a side view of the upper-torso garment 10, the upper-torso garment 10 includes a posterior portion 16, which typically covers at least part of a wearer's back when the upper-torso garment 10 is in an in-use state and an anterior portion 18 that typically covers at least part of a wearer's chest in the in-use state.

Furthermore, the upper-torso garment 10 includes various parts that may also be referred to when describing aspects of the disclosure. For instance, the upper-torso garment 10 includes shoulder straps 20, 22, as well as arm holes 24, 26, and a neckline 28, which generally forms a perimeter around a neck-receiving aperture. In addition, the upper-torso garment 10 includes a breast-covering portion 30 on the left side 12 and a breast-covering portion 32 on the right side 14, and a center bridge 34 is positioned between the breast-covering portions 30, 32. The upper-torso garment 10 also includes a series of encapsulation portions 35A, 35B, 35C, 35D, 35E, and 35F that form a perimeter around at least a portion of the breast-covering portions 30, 32. In some instances, a combination of the breast-covering portions, the center bridge, and the encapsulation portions may collectively form a chest-covering portion.

Moreover, the upper-torso garment 10 includes an upper-chest portion 39, a left underarm portion 36, a right underarm portion 38, a left wing 40, and a right wing 42. The posterior portion 16 includes a racerback-style rear panel having a main trunk 44 with rear straps 46 and 48. The main trunk 44 and the rear straps 46, 48 generally form a "T" shape or a "Y" shape, and the rear straps 46, 48 connect with the shoulder straps 20, 22. In aspects, the rear straps 46, 48 may be integrally knit with the shoulder straps 20, 22. As used herein, the term "integral" or "integrally knit" may mean a textile or fabric having a yarn from one or more knitted courses being interlooped with one or more knitted courses of another area. A chest band 50 extends circumferentially beneath the breast-covering portions 30, 32 and the left and right wings 40, 42 and wraps entirely around to the posterior portion 16. The chest band 50 is illustrated without any clasp or other releasable connector, which might be included in an alternative aspect. These relative regions and parts are provided for explanatory and illustrative purposes and are not necessarily intended to demarcate precise areas of the upper-torso garment 10. However, the upper-torso garment 10 may include structural elements, such as seams or transition regions that provide logical divisions or demarcation.

The upper-torso garment 10 may include other parts, regions, and portions that are not necessarily denoted in FIGS. 1-3, such as a cradle region, underwire, and the like. In addition, as indicated above, the bra-style, upper-torso garment 10 depicted in FIGS. 1-3 is merely illustrative of one type of upper-torso garment, and in other aspects of this disclosure, an upper-torso garment may have sleeves, an abdomen-covering portion, a lumbar-covering portion, integral shorts or pants (e.g., such as in a unitard), and the like.

In accordance with an aspect of this disclosure, the upper-torso garment 10 includes a knit-textile region, and as used herein, "knit-textile region" generally refers to at least a portion of the upper-torso garment 10 constructed of one or more yarn strands that are interlooped with one another. To aid in explanation, FIG. 1 identifies an example of a knit-textile region 52, and additional details of the knit-textile region 52 are further depicted in a magnified view 54, which illustrates an example of a knit structure 56. As depicted by the partially exploded view 58, the knit structure 56 includes courses of interlooped front stitches 60 and courses of interlooped back stitches 62.

Although the knit-textile region 52 in FIG. 1 is an illustrative example, the knit structure 56 depicts high-level aspects of knit structures that may be included at various knit-textile regions in the upper-torso garment 10. For instance, the knit structure 56 is illustrative of a dual-layer knit or spacer fabric in which the courses of interlooped front stitches 60 form one layer or side of a fabric and the courses of interlooped back stitches 62 form the other layer or side of the fabric. Moreover, the knit-textile region 52 is identified for illustrative purposes and serves as an example to aid in the explanation and depiction of more specific aspects of knit structures discussed herein. In other aspects of this disclosure, the upper-torso garment 10 includes one or more other knit-textile regions that are larger than the knit-textile region 52, are positioned in other regions and parts of the upper-torso garment 10, and/or are formed of multiple knit zones, which include similar but slightly varied knit structures. For example, at least some of the anterior portion of the upper-torso garment 10 may include knit-textile regions including the chest band 50, the breast-covering portions 30, 32, the center bridge 34, the encapsulation portions 35A-F, the left and right underarm portions 36, 38, the left and right wings 40, 42, the shoulder straps 20, 22, the rear straps 46, 48, and/or any combination thereof. Continuing with this example, a knit-textile region may be included at or extended about two or more portions of the upper-torso garment 10 and may have multiple knit zones with varying knit structures at different portions of the upper-torso garment 10. Further, any of these portions of the upper-torso garment 10 may be integrally knit as a continuous knit panel or may be separate knit panels.

In an aspect of the present disclosure, the breast-covering portions 30, 32 include various identifying features, and for example, the breast-covering portions 30, 32 are generally positioned superior to the chest band 50 and inferior to the shoulder straps 20, 22. In addition, the breast-covering portions 30, 32 are generally on the anterior portion 18 of the upper-torso garment 10, extending between the left and right underarm portions 36, 38 and extending between the left and right wings 40, 42. Furthermore, as suggested by FIGS. 1-3, the breast-covering portions 30, 32 may be separated by the center bridge 34, may be bordered on one or more sides by the encapsulation portions 35A-F and the left and right wings 40, 42. In some other aspects, the center bridge 34 may be omitted, such that the breast-covering portions 30, 32 form a single breast-covering portion that spans the anterior side from left-side wings and underarm portions to the right-side wings and underarm portions. Likewise, the width of the encapsulation portions 35A-F may be reduced, or the encapsulation portions 35A-F may be omitted in other aspects of the disclosure. As illustrated by the side views of FIGS. 2 and 3, the breast-covering portions 30, 32 are dome-shaped and include a convex exterior surface 70, and as such include a concave interior surface that is not viewable in the perspectives shown in FIGS. 1-3.

The breast-covering portions 30, 32 may cover and possibly contact a chest region of the wearer when the upper-torso garment 10 is in an in-use state, such as when donned by a human or mannequin. Furthermore, the breast-covering portions 30, 32 may provide compressive support to respective breast tissue of a wearer. The size and shape of the breast-covering portions 30, 32 depicted in FIGS. 1-3 is illustrative of one aspect of the subject matter described herein, and in other aspects, the size and shape may be varied.

Turning to aspects of this disclosure that relate to knit-textile regions, in one such aspect, the upper-torso garment 10 includes knit-textile regions 64, 66, and 68. With reference to FIG. 1, the knit-textile region 64 is included at the breast-covering portion 30, the knit-textile region 66 is included at the left wing 40, and the knit-textile region 68 extends about the breast-covering portion 32 and the right wing 42. Moreover, the knit-textile region 68 includes a first knit zone 164 at the breast-covering portion 32 and a second knit zone 166 at the right wing 42. Though not identified in FIG. 1, the knit-textile regions 64, 66, 68 are also included in the upper-torso garment 10 at the opposing side (i.e., the knit-textile region 64 can be included at the breast-covering portion 32, the knit-textile region 66 can be included at the right wing 42, and the knit-textile region 68 extends about the breast-covering portion 30 and the left wing 40).

Figure 4:
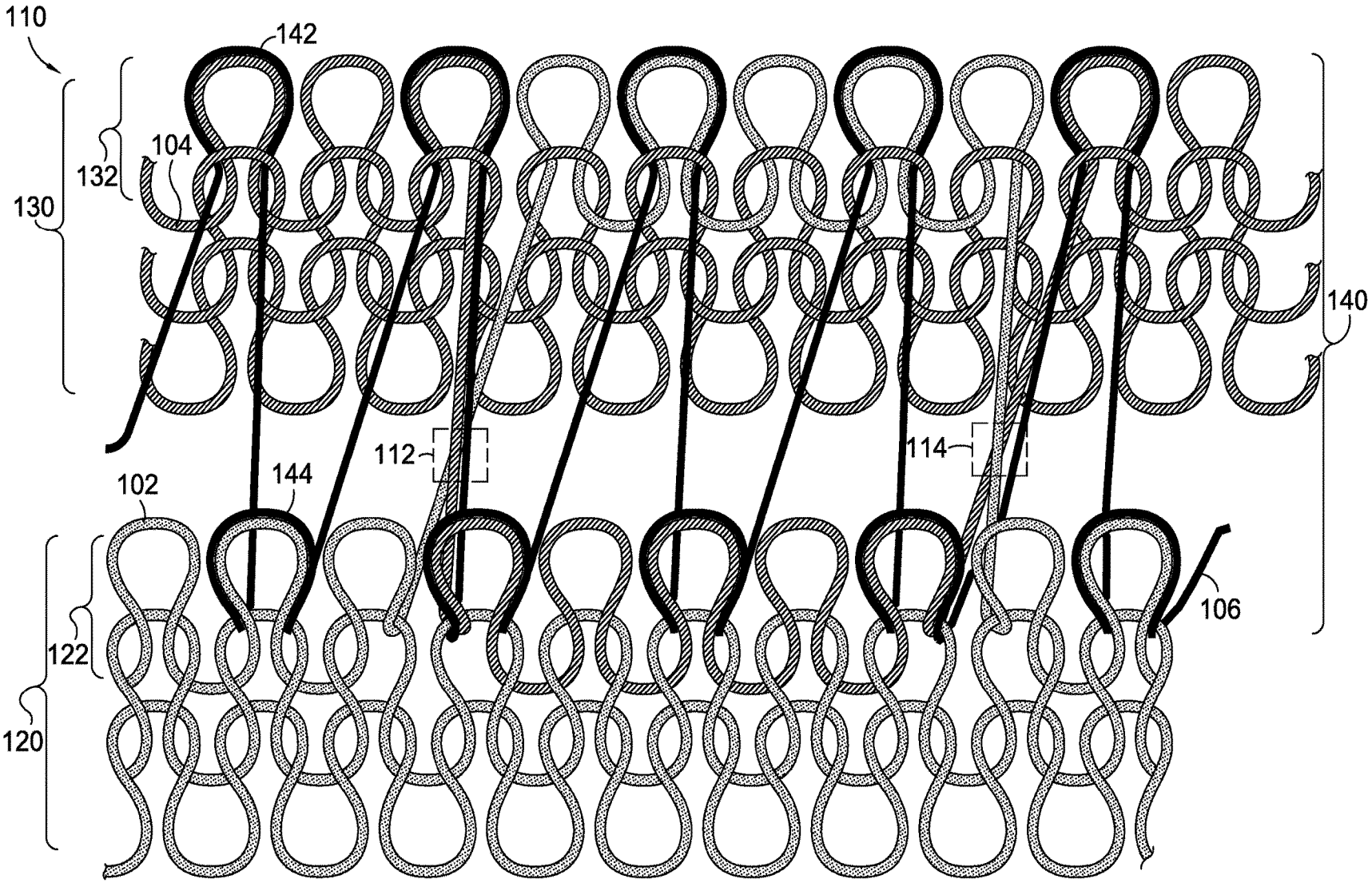
FIG. 4 depicts a knit schematic, which illustrates a tubular-jacquard knit structure with a single tuck binder course in combination with interlocking crossovers of a front-side course and a back-side course in accordance with an aspect of this disclosure.

With reference to FIG. 4, a knit schematic is depicted that illustrates features of a knit structure 110 of the knit-textile region 64. Generally, the knit structure 110 is a tubular-jacquard knit structure that includes a single tuck binder course. In FIG. 4, the knit structure 110 includes a plurality of front-side courses 120 and a plurality of back-side courses 130, which are constructed of a first yarn strand 102 and a second yarn strand 104. Each course of the plurality of front-side courses 120 includes consecutive front-side stitches, and similarly, each course of the plurality of back-side courses 130 includes consecutive back-side stitches. The knit structure 110 also includes a single tuck binder course 140 of tuck binder stitches that is constructed of a third yarn strand 106. FIG. 4 also depicts one of the front-side courses 122 intermittently interlocking with a back-side course 132 by way of the first yarn strand 102 extending from the front-side course 122 to the back-side course 132. In addition, at a location corresponding with the first yarn strand 102 extending to the back-side course 132, the second yarn strand 104 extends from the back-side course 132 to the front-side course 122.

In accordance with an aspect of this disclosure, this structure in which the first yarn strand 102 extends from the front-side course 122 to the back-side course 132 and the second yarn strand 104 extends from the back-side course 132 to the front-side course 122 is referred to as an "interlocking crossover," which is identified by reference numeral 112. In FIG. 4, another interlocking crossover 114 is illustrated in which the first yarn strand 102 extends from the back-side course 132 to the front-side course 122, and the second yarn strand 104 extends from the front-side course 122 to the back-side course 132.

Continuing with FIG. 4, the single tuck binder course 140 crosses back and forth between the front-side and back-side courses 122, 132, tucks every other front-side stitch and every other back-side stitch, and connects the front-side and back-side courses 122, 132 to one another. As depicted in FIG. 4, the third yarn strand 106 forms a tuck binder stitch 142 in the back-side course 132 and then transfers to the front-side course 122 to form another tuck binder stitch 144. Further, the third yarn strand 106 transfers back and forth between the front-side and back-side courses 122, 132 in a sinuous manner to form a tuck binder stitch at every other stitch position in the front-side course 122 and at every other stitch position in the back-side course 132. To avoid overcrowding of the knit structure 110 illustrated in FIG. 4, other single courses of tuck binder stitches are not depicted (e.g., in the courses formed below the front-side and back-side courses 122, 132), but in other aspects of the disclosure, other single courses of tuck binder stitches could be included to bind other front-side and back-side courses.

In FIG. 4, the first, second, and third yarn strands 102, 104, 106 are depicted with different appearances than one another, which may represent differences in colors, material compositions, and/or other structural features. For example, the first yarn strand 102 may be a different color than the second yarn strand 104, and in an aspect of this disclosure, the difference in color between the first and second yarn strands 102, 104 results in a striping pattern when the first and second yarn strands 102, 104 intermittently switch back and forth between the front-side course 122 and the back-side course 132, such as the illustrative striping patterns in FIGS. 1-3 in the breast-covering portions 30, 32 and the left and right underarm portions 36, 38. The upper-torso garment 10 in FIGS. 1-3 is merely an example of one striping pattern that might be achieved, and in other aspects, an upper-torso garment might have a different pattern. In addition, the first yarn strand 102 and the second yarn strand 104 might have the same or similar appearance, such that a visual striping pattern is not created by the switching back and forth of the first yarn strand 102 and the second yarn strand 104 between the front-side and back-side courses 122, 132.

Figure 5:
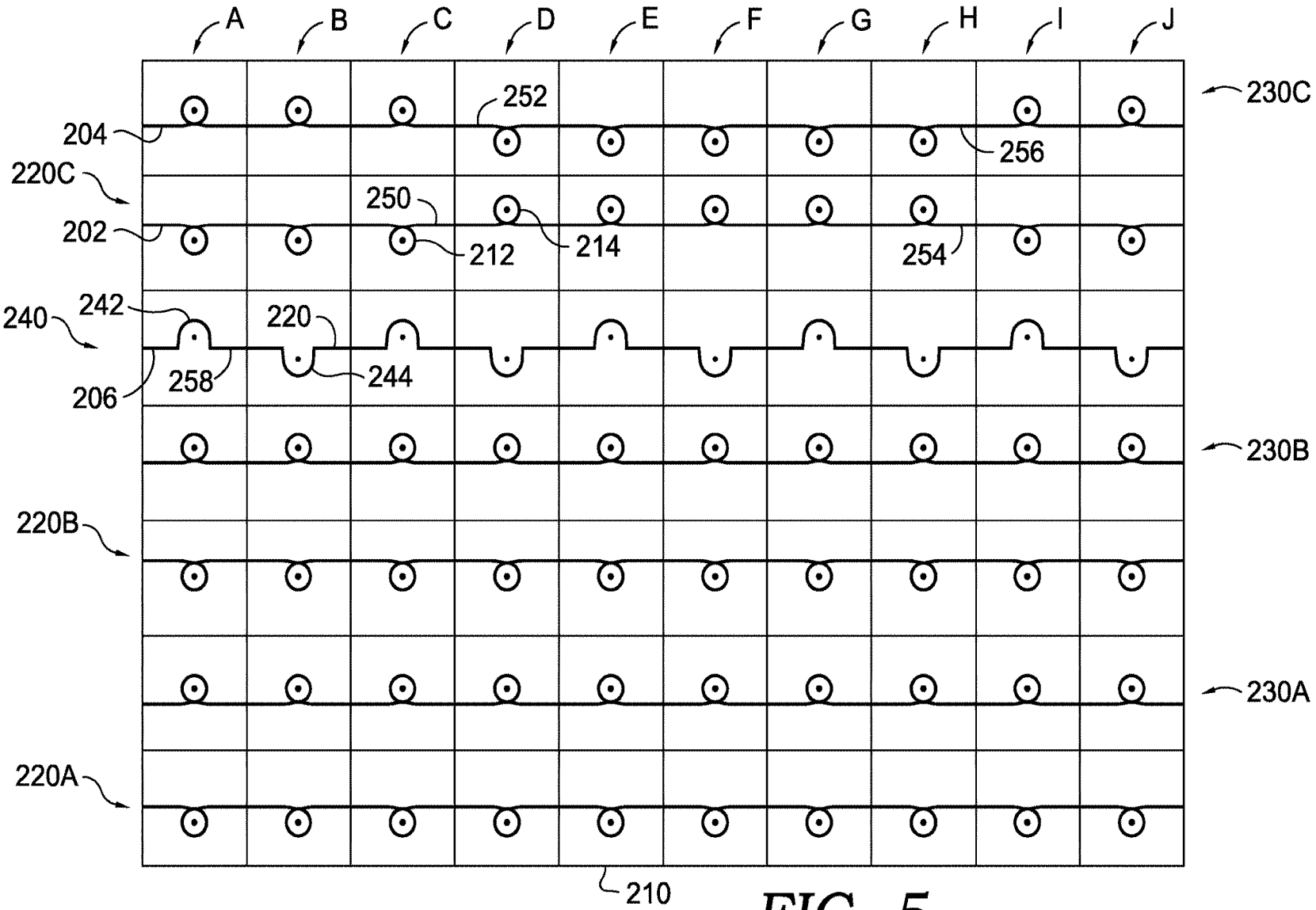
FIG. 5 depicts knit-program notations corresponding with the knit schematic in FIG. 4.

Referring now to FIG. 5, an example of a knit diagram 210 corresponding with the knit structure 110 of FIG. 4 is depicted. The knit diagram 210 includes a plurality of columns and rows. Each column represents a stitch position and each row represents a yarn strand. Within each row, the stitch type is designated, together with an indication of whether the stitch is on the front bed or the back bed. A stitch notation beneath the "yarn" is on the front bed, and a stitch notation above the "yarn" is on the back bed. For example, a row 220C designates a stitch type and stitch location for a first yarn strand 202 at ten stitch positions A-J. The stitch notation 212 designates a stitch on the front bed, and the stitch notation 214 designates a stitch on the back bed. As such, the line segment 250 would correspond with the transfer (e.g., the interlocking crossover) from the front bed to the back bed.

In FIG. 5, each of the rows 220A-C prescribes knit structures for the first yarn strand 202, each of rows 230A-C prescribes knit structures for a second yarn strand 204, and the row 240 prescribes a knit structure for a third yarn strand 206. The rows 220A and 220B prescribe ten stitches with the first yarn strand 202 on the front side of the knit structure, and the rows 230A and 230B prescribe ten stitches with the second yarn strand 204 on the back side of the knit structure. As such, rows 220A, 220B, 230A, and 230B correspond with the first two front-side courses and the first two back-side courses in FIG. 4.

Continuing with FIG. 5, the row 220C designates stitches for the first yarn strand 202, which corresponds to the first yarn strand 102 of FIG. 4, and similarly, the row 230C designates stitches for the second yarn strand 204, which corresponds to the second yarn strand 104 of FIG. 4. Accordingly, the row 220C designates three stitches on the front side, a transfer to the back side (i.e., line segment 250), five stitches on the back side, a transfer to the front side (i.e., line segment 254), and two stitches on the front side. Moreover, the row 230C sequentially designates three stitches on the back side, a transfer to the front side (i.e., line segment 252), five stitches on the front side, a transfer to the back side (i.e., line segment 256), and two stitches on the back side. When executed, the transfers designated by 250 and 252 translate into the interlocking crossover 112, and the transfers designated by 254 and 256 translate into the interlocking crossover 114.

With further reference to FIG. 5, the row 240 designates stitches for the third yarn strand 206, which corresponds to the third yarn strand 106 of FIG. 4. As shown in FIG. 5, the row 240 designates that the third yarn strand 206 forms a tuck binder stitch 242 on the back side, transfers to the front side (i.e., line segment 258), forms a tuck binder stitch 244 on the front side, and then transfers to the back side (i.e., line segment 220). This pattern repeats as the third yarn strand 206 transfers back and forth between the front side and the back side while forming tuck binder stitches at every other front stitch position and every other back stitch position. As such, the combination of the stitches prescribed by the rows 220C, 230C, and 240 translate to the front-side course 122, the back-side course 132, and the single tuck binder course 140 of FIG. 4.

Figure 6:
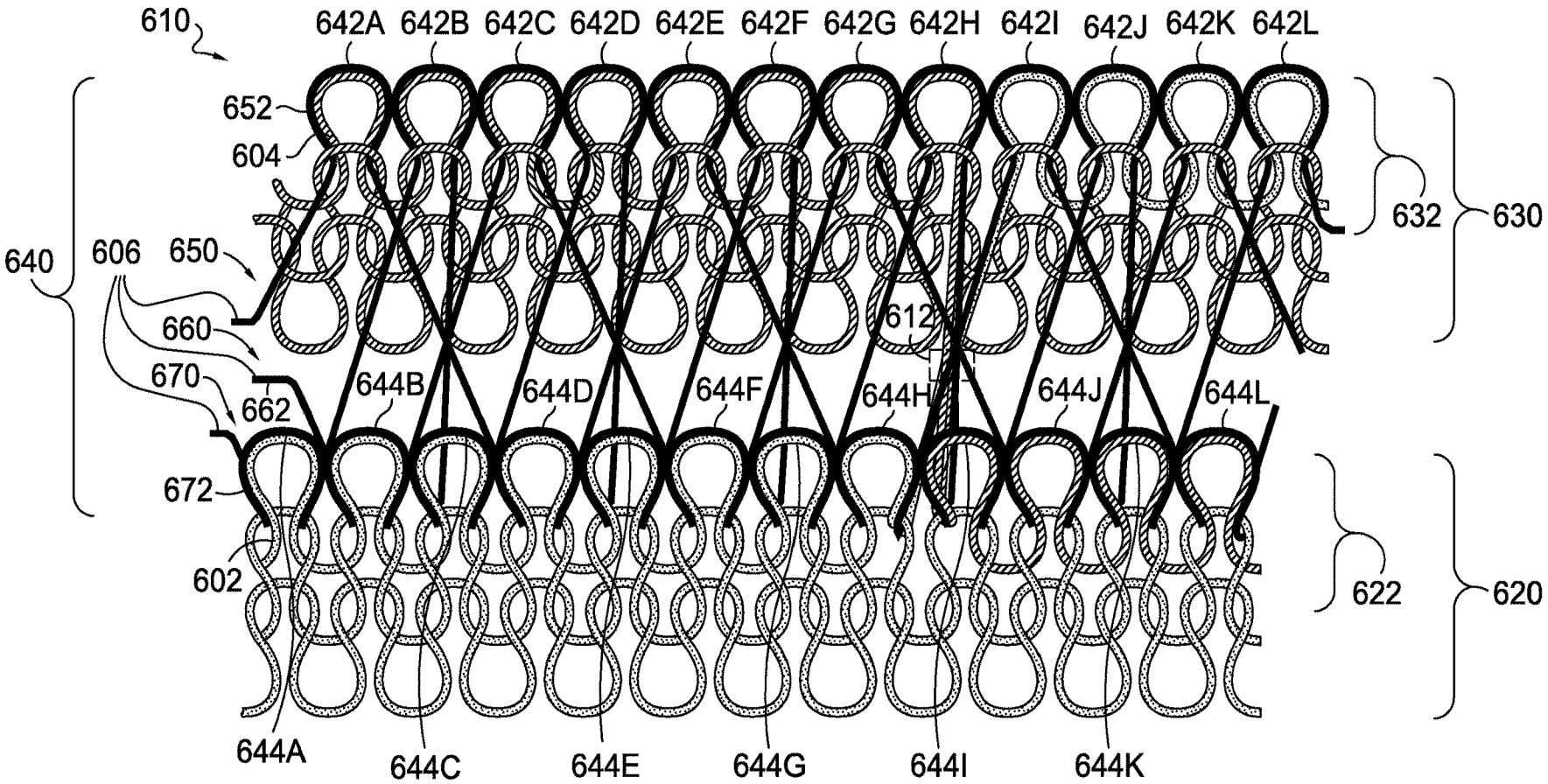
FIG. 6 depicts a knit schematic, which illustrates a tubular-jacquard knit structure with a plurality of tuck binder courses in combination with interlocking crossovers of a front-side course and a back-side course in accordance with an aspect of this disclosure.

Moving to FIG. 6, a schematic is depicted that illustrates some features of a knit structure 610 of the knit-textile region 66. Generally, the knit structure 610 is a tubular-jacquard knit structure that includes a plurality of tuck binder courses. The knit structure 610 includes a plurality of front-side courses 620 and a plurality of back-side courses 630 that are constructed of a first yarn strand 602 and a second yarn strand 604. Each course of the plurality of front-side courses 620 includes consecutive front-side stitches, and similarly, each course of the plurality of back-side courses 630 includes consecutive back-side stitches. In addition, a front-side course 622 is intermittently interlocked with a back-side course 632, similar to the knit structure 110 described above with reference to FIGS. 4 and 5. Accordingly, FIG. 6 depicts the first yarn strand 602 extending from the front-side course 622 to the back-side course 632 and the second yarn strand 604 extending from the back-side course 632 to the front-side course 622 at an interlocking crossover 612.

In FIG. 6, the knit structure 610 also includes a plurality of tuck binder courses 640 that cross back and forth between the front-side and back-side courses 622, 632, tuck every front-side stitch and every back-side stitch, and connect the front-side and back-side courses 622, 632 to one another. Moreover, the plurality of tuck binder courses 640 include a first tuck binder course 650, a second tuck binder course 660, and a third tuck binder course 670, which are constructed of a third yarn strand 606. Each of the first, second, and third tuck binder courses 650, 660, 670 are formed of a different portion of the third yarn strand 606. As such, the third yarn strand 606 includes a first binder strand portion 652, a second binder strand portion 662, and a third binder strand portion 672, which respectively form the first, second, and third tuck binder courses 650, 660, 670. Collectively, the first, second, and third binder strand portions 652, 662, 672 form a tuck binder stitch at every front stitch position and every back stitch position of the front-side and back-side courses 622, 632 (e.g., tuck binder stitches 642A-L and 644A-L).

As depicted in FIG. 6, the first binder strand portion 652 forms a tuck binder stitch 642A in the back-side course 632, floats two stitch positions (i.e., 642B, 644B and 642C, 644C) while transferring to the front-side course 622 to form a tuck binder stitch 644D, and then immediately transfers to the back-side course 632 to form another tuck binder stitch 642E. The first binder strand portion 652 continues in this same manner to form additional tuck binder stitches 644H, 642I, 644L. The second binder strand portion 662 forms tuck binder stitches in a similar manner as the first binder strand portion 652, and as shown in FIG. 6, the second binder strand portion 662 forms a tuck binder stitch 644B in the front-side course 622, immediately transfers to the back-side course 632 to from a tuck binder stitch 642C, then floats two stitch positions (i.e., 642D, 644D and 642E, 644E) while transferring to the front-side course 622 to form a tuck binder stitch 644F, and continues in this manner to form additional tuck binder stitches 642G, 644J, 642K. Furthermore, the third binder strand portion 672 transfers back and forth between the front-side course 622 and the back-side course 632 in a sinuous manner to form a tuck binder stitch at every other front stitch position and every other back stitch position, thereby forming tuck binder stitches 642B, 642D, 642F, 642H, 642J, 642L on the back-side course 632 and tuck binder stitches 644A, 644C, 644E, 644G, 644I, 644K on the front-side course 622.

In FIG. 6, the first, second, and third yarn strands 602, 604, 606 are depicted as having different appearances than one another, which may represent differences in colors, material compositions, and/or structural features, like the first, second, and third yarn strands 102, 104, 106 of FIG. 4. Moreover, in an aspect of the present disclosure, the first, second, and third yarn strands 602, 604, 606 may include the same features and/or any combination thereof as those of the first, second, and third yarn strands 102, 104, 106 of FIG. 4, as discussed above. In a further aspect of this disclosure, the first, second, and third binder strand portions 652, 662, 672 may be formed of different yarn strands, which may include the same features and/or any combination thereof as those of the first, second, and third yarn strands 102, 104, 106 of FIG. 4, as discussed above. Additionally, to avoid overcrowding of the knit structure 610 illustrated in FIG. 6, other courses of tuck binder stitches are not depicted (e.g., in the courses formed below the front-side and back-side courses 622, 632), but in other aspects of the disclosure, other courses of tuck binder stitches could be included to bind other front-side and back-side courses.

Figure 7:
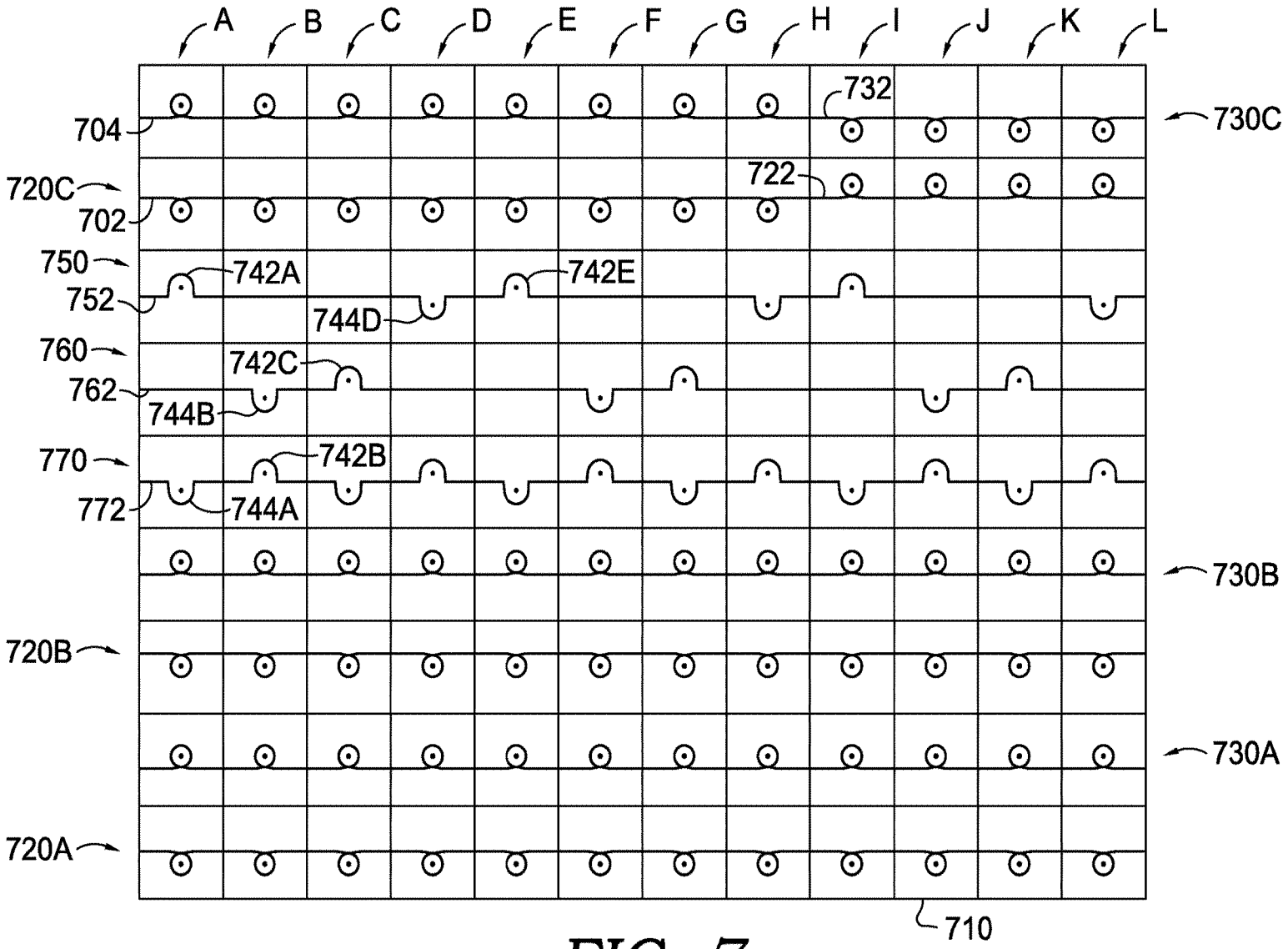
FIG. 7 depicts knit-program notations corresponding with the knit schematic in FIG. 6.

With reference to FIG. 7, a knit diagram 710 corresponding with the knit structure 610 of FIG. 6 is depicted. As shown, the knit diagram 710 designates a stitch type and a stitch location for each yarn strand represented by rows 720A-C, 730A-C, 750, 760, and 770 at twelve stitch positions represented by columns A-L. Each of the rows 720A-C prescribes knit structures for a first yarn strand 702, and likewise, each of the rows 730A-C prescribes knit structures for a second yarn strand 704. The rows 720A and 720B prescribe twelve stitches with the first yarn strand 702 on the front side of the knit structure, and the rows 730A and 730B prescribe twelve stitches with the second yarn strand 704 on the back side of the knit structure. As such, rows 720A, 720B, 730A, and 730B correspond with the first two front-side courses and the first two back-side courses in FIG. 6.

Staying with FIG. 7, the row 720C designates stitches for the first yarn strand 702, which corresponds to the first yarn strand 602 of FIG. 6, and similarly, the row 730C sequentially designates stitches for the second yarn strand 704, which corresponds to the second yarn strand 604 of FIG. 6. Accordingly, the row 720C designates eight stitches on the front side, a transfer to the back side (i.e., line segment 722), and four stitches on the back side. Moreover, the row 730C sequentially designates eight stitches on the back side, a transfer to the front side (i.e., line segment 732), and four stitches on the front side. When executed, the transfers designated by 722 and 732 translate into the interlocking crossover 612 of FIG. 6.

With continued reference to FIG. 7, a row 750 designates stitches for a first binder strand portion 752, which corresponds to the first binder strand portion 652 of FIG. 6, a row 760 designates stitches for a second binder strand portion 762, which corresponds to the second binder strand portion 662 of FIG. 6, and a row 770 designates stitches for a third binder strand portion 772, which correspond to the third binder strand portion 672 of FIG. 6. In FIG. 7, the row 750 sequentially designates that the first binder strand portion 752 forms a tuck binder stitch 742A on the back side, floats two stitch positions (i.e., B and C), forms a tuck binder stitch 744D on the front side, forms a tuck binder stitch 742E on the back side, and then floats two stitch positions (i.e., F and G). As such, the first binder strand portion 752 includes a pattern over four, consecutive stitch positions (i.e., float two stitch positions, form a tuck binder stitch on the front side at a next stitch positon, and then form a tuck binder stitch on the back side at a last stitch position of the pattern).

As further depicted in FIG. 7, the row 760 sequentially designates that the second binder strand portion 762 forms a tuck binder stitch 744B on the front side, forms a tuck binder stitch 742C on the back side, floats two stitch positions, and then repeats this same pattern over the next four, consecutive stitch positions. As such, the second binder strand portion 762 includes a pattern that is similar to that of the first binder strand portion 752 but over a different, four consecutive stitch positions. Continuing, the row 770 sequentially designates that the third binder strand portion 772 forms a tuck binder stitch 744A on the front side, forms a tuck binder stitch 742B on the back side, and then continues to form a tuck binder stitch at every other front stitch position and every other back stitch position. Accordingly, the combination of the stitches prescribed by the rows 720C, 730C, 750, 760, and 770 translate to the front-side course 622, the back-side course 632, the first tuck binder course 650, the second tuck binder course 660, and the third tuck binder course 670 of FIG. 6.

In an aspect of the present disclosure, a density of tuck binder stitches and/or interlocking crossovers (e.g., amount of tuck binder stitches and/or interlocking crossovers in a given knit-textile region) included among a knit-textile region is selected to achieve an amount of mechanical stretch, flexural rigidity, elongation, and/or compressive force against a wearer's tissue (e.g., breast tissue). That is, a knit-textile region may include multiple knit zones, (e.g., single-layer knit zones, dual-layer knit zones, or a combination thereof) that have varied amounts of tuck binder stitches and interlocking crossovers. More specifically, a knit zone that includes tuck binder stitches at every stitch position and fewer interlocking crossovers among a given number of stitches (e.g., the knit structure 601 described in connection with FIGS. 6 and 7) will elongate less and have a greater flexural rigidity than another knit zone that includes tuck binder stitches at less stitch positions and more interlocking crossovers among a given number of stitches (e.g., the knit structure 110 described in connection with FIGS. 4 and 5). As such, the knit zone with more tuck stitches and less interlocking crossovers may provide more compression and stiffness than the other knit zone under the same conditions (e.g., garment size and wearer dimensions), which may provide greater mechanical elongation and less stiffness. Applying these principles, an aspect of the present disclosure includes an upper-torso garment including a knit-textile region (e.g., the knit-textile region 68) with two or more knit zones having varied knit structures (e.g., the first and second knit zones 164, 166 of the knit-textile region 68), which provide a respective amount of flexural rigidity and elongation based at least in part on the density of tuck binder stitches and interlocking crossovers.

Figure 8:
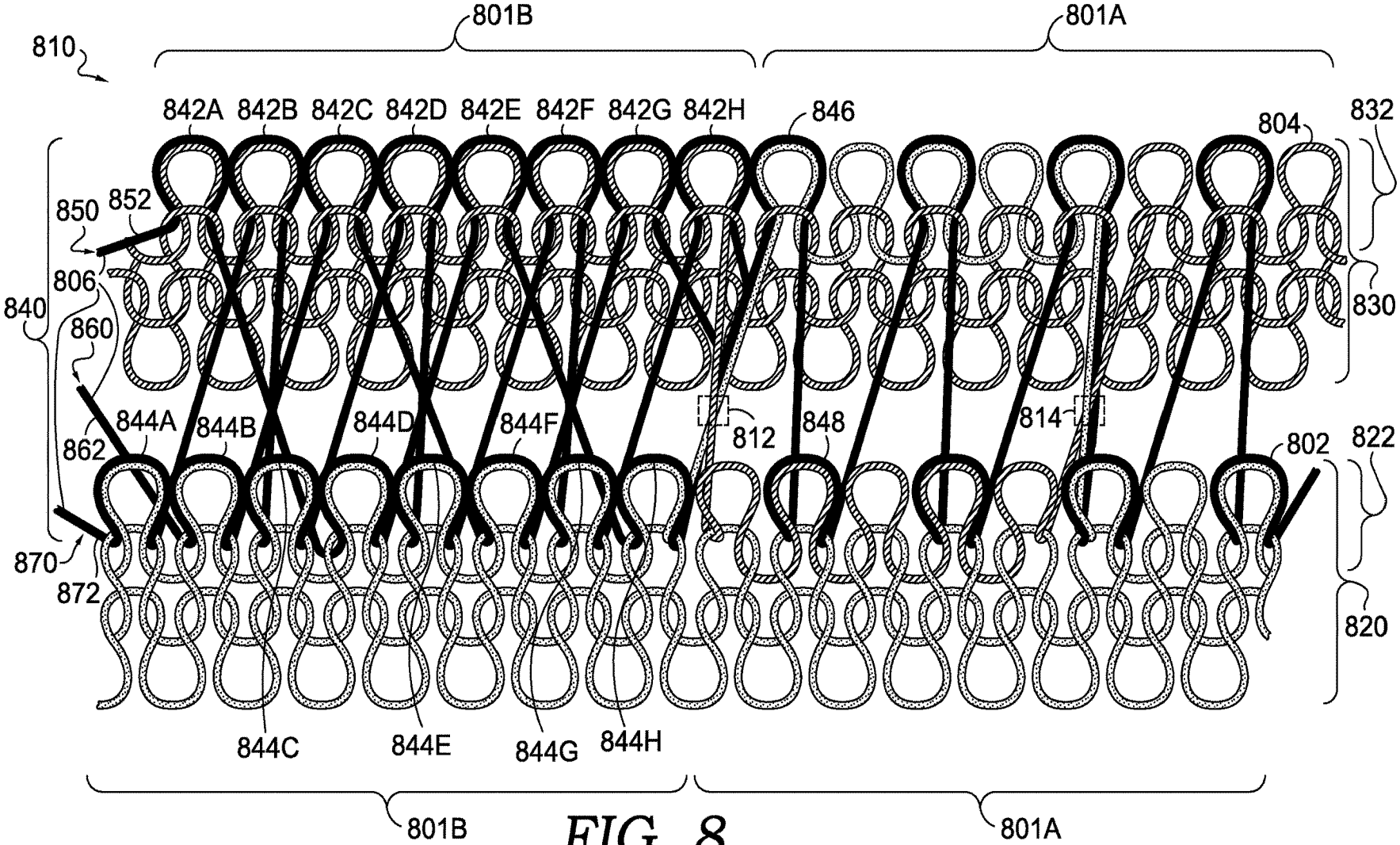
FIG. 8 depicts a knit schematic, which illustrates a tubular-jacquard knit structure with varied tuck binder courses at different knit zones in combination with interlocking crossovers of a front-side course and a back-side course in accordance with an aspect of this disclosure.

In accordance with these aspects, FIG. 8 depicts a knit schematic of a knit structure 810 that includes varied tuck binder courses and interlocking crossovers at different knit zones. Generally, the knit structure 810 illustrates features included in the knit-textile region 68 at each of the first and second knit zones 164, 166. As depicted in FIG. 8, the knit structure 810 is a tubular-jacquard knit structure that includes a single tuck binder course at a first knit zone 801A and a plurality of tuck binder courses at a second knit zone 801B, which respectively correspond to the first and second knit zones 164, 166 of the knit-textile region 68. Moreover, the knit structure 810 is similar to the knit structure 110 of FIG. 4 at the first knit zone 801A. The second knit zone 801B is similar to the knit structure 610 of FIG. 6. As such, the knit structure 810 includes features that are similar to and/or the same as those of the knit structures 110, 610, as discussed above in connection with FIGS. 4-7. Further, in an aspect of the present disclosure, the knit structure 810 may include the same features and/or any combination thereof as the knit structures 110, 610.

Continuing with FIG. 8, as depicted, the knit structure 810 includes a plurality of front-side courses 820 and a plurality of back-side courses 830 constructed with a first yarn strand 802 and a second yarn strand 804, both of which extend throughout the first and second knit zones 801A, 801B. Each course of the plurality of front-side courses 820 includes consecutive front-side stitches, and similarly, each course of the plurality of back-side courses 830 includes consecutive back-side stitches. In addition, a front-side course 822 is intermittently interlocked with a back-side course 832, similar to the knit structures 110, 610 described above with reference to FIGS. 4-7. Accordingly, FIG. 8 depicts the first yarn strand 802 extending from the front-side course 822 to the back-side course 832 and the second yarn strand 804 extending from the back-side course 832 to the front-side course 822 at an interlocking crossover 812. Further, another interlocking crossover 814 is illustrated in which the first yarn strand 802 extends from the back-side course 832 to the front-side course 822, and the second yarn strand 804 extends from the front-side course 822 to the back-side course 832. As can be seen, the interlocking crossovers 812, 814 are respectively positioned at a transition point (not identified) between the first and second knit zones 801A, 801B and within the first knit zone 801A. Thus, the knit structure 810 includes an interlocking crossover (e.g., 814) in the first knit zone 801A but does not include any interlocking crossovers in the second knit zone 801B.

As mentioned, the knit structure 810 also includes varied tuck binder courses, and an amount of tuck binder courses included in the knit structure 810 at the first knit zone 801A is different than an amount of tuck binder courses at the second knit zone 801B. As depicted in FIG. 8, in the second knit zone 801B, the knit structure 810 has a plurality of tuck binder courses 840 including a first tuck binder course 850, a second tuck binder course 860, and a third tuck binder course 870, which are constructed with a third yarn strand 806. Each of the first, second, and third tuck binder courses 850, 860, 870 are formed of a different portion of the third yarn strand 806. As such, the third yarn strand 806 includes a first binder strand portion 852, a second binder strand portion 862, and a third binder strand portion 872, which respectively form the first, second, and third tuck binder courses 850, 860, 870. Collectively, the first, second, and third binder strand portions 852, 862, 872 form a tuck binder stitch at every front stitch position and every back stitch position of the front-side and back-side courses 822, 832 in the second knit zone 801B (e.g., tuck binder stitches 842A-H and 844A-H).

Continuing, the first, second, and third binder strand portions 852, 862, 872 have a same spatial arrangement and relationship as the first, second, and third binder strand portions 652, 662, 672 of FIG. 6. Thus, as is depicted in FIG. 8, in the second knit zone 801B, the first binder strand portion 852 forms a tuck binder stitch 842A in the back-side course 832, floats two stitch positions (i.e., 842B, 844B and 842C, 844C) while transferring to the front-side course 822 to form a tuck binder stitch 844D, and then immediately transfers to the back-side course 832 to form another tuck binder stitch 842E. The second binder strand portion 862 forms tuck binder stitches in a similar manner, and in the second knit zone 801B, the second binder strand portion 862 forms a tuck binder stitch 844B in the front-side course 822, immediately transfers to the back-side course 832 to from a tuck binder stitch 842C, then floats two stitch positions (i.e., 842D, 844D and 842E, 844E) while transferring to the front-side course 822 to form a tuck binder stitch 844F, and then immediately transfers to the back-side course to form a tuck binder stitch 842G. Furthermore, in the second knit zone 801B, the third binder strand portion 872 transfers back and forth between the front-side course 822 and the back-side course 832 in a sinuous manner to form a tuck binder stitch at every other front stitch position and every other back stitch position, thereby forming tuck binder stitches 842B, 842D, 842F, 842H on the back-side course 832 and tuck binder stitches 844A, 844C, 844E, 844G on the front-side course 822.

Turning to the first knit zone 801A, as depicted in FIG. 8, the knit structure 810 includes a single tuck binder course that interloops with every other front-side stitch and every other back-side stitch, and connects the front-side and back-side courses 822, 832 to one another. As depicted in FIG. 8, the first tuck binder course 850 transitions from the second knit zone 801B and extends throughout the first knit zone 801A in a manner like the third yarn strand 106 in the knit structure 110 of FIG. 4. Thus, the first tuck binder course 850 forms the single tuck binder course of the knit structure 810 in the first knit zone 801A, and as depicted in FIG. 8, in the first knit zone 801A, the first binder strand portion 852 of the third yarn strand 806 forms a tuck binder stitch 846 in the back-side course 832 and then transfers to the front-side course 822 to form another tuck binder stitch 848. Further, throughout the first knit zone 801A, the first binder strand portion 852 transfers back and forth between the front-side and back-side courses 822, 832 in a sinuous manner to form a tuck binder stitch at every other stitch position in the front-side course 822 and at every other stitch position in the back-side course 832.

In addition, to avoid overcrowding of the knit structure 810 illustrated in FIG. 8, other tuck binder courses of tuck binder stitches are not depicted (e.g., in the courses formed below the front-side and back-side courses 822, 832), but in other aspects of the disclosure, other tuck binder courses of tuck binder stitches could be included to bind other front-side and back-side in a same or similar manner as the first, second, and third tuck binder courses 850, 860, 870 bind the front-side and back-side courses 822, 832 in each of the first and second knit zones 801A, 801B. Other aspects contemplate that first, second, and third tuck binder courses and in turn, the first, second, and third binder strand portions may be included at different positions in the knit structure 810, while maintaining a same spatial relationship. In such aspects, the first, second, and third binder strand portions form tuck stitches at every stitch position on the front-side and back-side courses in the second knit zone, but each of the tuck binder stitches formed by a given binder strand portion may be at a different stitch position and/or on a different side.

Furthermore, FIG. 8 illustratively depicts a quantity of front and back wales included in each of the first and second knit zones 801A, 801B. In FIG. 8, each front-side stitch (e.g., a single loop) of the front-side course 822 represents a front wale, and likewise, each back-side stitch (e.g., a single loop) of the back-side course 832 represents a back wale. As such, a total number of front-side and back-side stitches of the front-side and back-side courses 822, 832 in each of the first and second knit zones 801A, 801B represents a quantity of front and back wales included in each respective knit zone. In one aspect, as is depicted in FIG. 8, the first knit zone 801A includes a same quantify of front and back wales, and the second knit zone 801B includes a same quantity of front and back wales.

In FIG. 8, the first, second, and third yarn strands 802, 804, 806 are depicted as having different appearances than one another, which may represent differences in colors, material compositions, and/or structural features like the first, second, and third yarn strands 102, 104, 106, 602, 604, 606 of FIGS. 4 and 6. Moreover, in an aspect of the present disclosure, the first, second, and third yarn strands 802, 804, 806 include the same features and/or any combination thereof as those of the first, second, and third yarn strands 102, 104, 106, 602, 604, 606 of FIGS. 4 and 6, as discussed above. In a further aspect of this disclosure, the first, second, and third binder strand portions 852, 862, 872 may be formed of different yarn strands, which may include the same features and/or any combination thereof as those of the first, second, and third yarn strands 102, 104, 106, 602, 604, 606 of FIGS. 4 and 6.

In additional aspects of this disclosure, each of the first, second, and third yarn strands 802, 804, 806 include a variety of yarn types. Such aspects contemplate that the first, second, and third yarn strands include a non-elastic (also sometimes referred to as a non-stretch yarn), which includes an amount of elasticity that provides a maximum stretch of less than 200% under load prior to returning to a non-stretched state when the load is removed. Continuing with these aspects, the non-elastic yarn type of the first yarn strand 802 and the second yarn strand 804 provides a maximum stretch of less than 100%. Examples of non-elastic yarn types include nylon and polyester. In one aspect, each of the first, second, and third yarn strands 802, 804, 806 include two ends of nylon 2/78D/68F (i.e., 2 ply where each ply is 78 decitex with 68 filaments). Other aspects contemplate that each of the first, second, and third yarn strands 802, 804, 806 include nylon 1/44D/34F covered elastic 78D.

Figure 9:
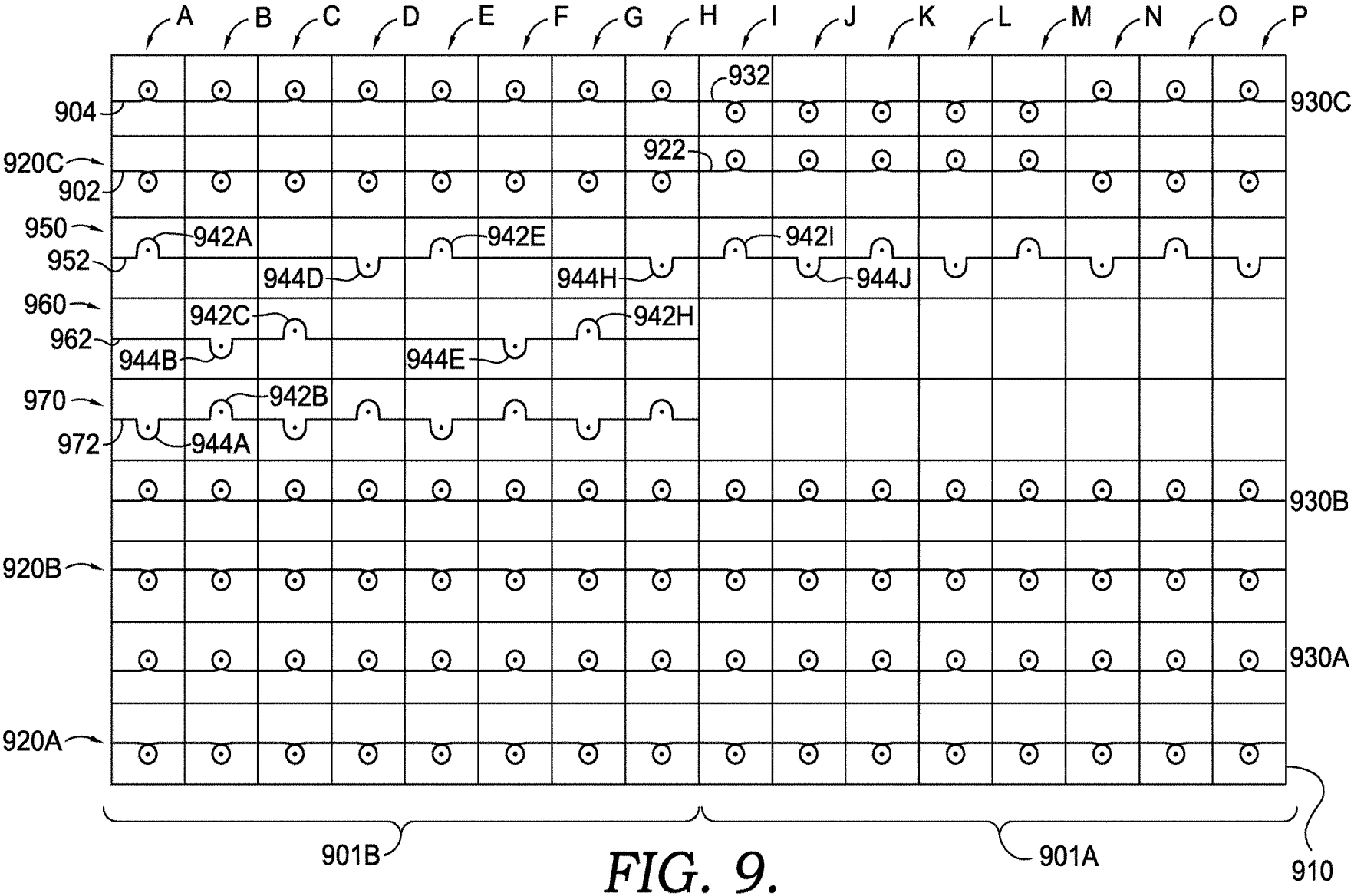
FIG. 9 depicts knit-program notations corresponding with the knit schematic in FIG. 8.

Now referring to FIG. 9, a knit diagram 910 corresponding with the knit structure 810 of FIG. 8 is depicted. As shown, the knit diagram 910 designates a stitch type and a stitch location for each yarn strand represented by rows 920A-C, 930A-C, 950, 960, and 970 at sixteen stitch positions represented by columns A-P. Moreover, the first eight, consecutive stitch positions (i.e., columns A-H) represent a second knit zone 901B, and the next eight, consecutive stitch positions (i.e., columns J-P) represent a first knit zone 901A. Each of the rows 920A-C prescribes knit structures for a first yarn strand 902, and likewise, each of the rows 930A-C prescribes knit structures for a second yarn strand 904. The rows 920A and 920B prescribe sixteen stitches with the first yarn strand 902 on the front side of the knit structure, and the rows 930A and 930B prescribe sixteen stitches with the second yarn strand 904 on the back side of the knit structure. As such, rows 920A, 920B, 930A, and 930B correspond with the first two front-side courses and the first two back-side courses in FIG. 8.

With continued reference to FIG. 9, the row 920C designates stitches for the first yarn strand 902, which corresponds to the first yarn strand 802 of FIG. 8, and similarly, the row 930C sequentially designates stitches for the second yarn strand 904, which corresponds to the second yarn strand 804 of FIG. 8. As such, the row 920C designates eight stitches on the front side, a transfer to the back side (i.e., line segment 922), five stitches on the back side, a transfer to the front side (i.e., line segment 924), and three stitches on the front side. The row 930C sequentially designates eight stitches on the back side, a transfer to the front side (i.e., line segment 932), five stitches on the front side, a transfer to the back side (i.e., line segment 934), and three stitches on the back side. When executed, the transfers designated by 922 and 932 translate into the interlocking crossover 812 of FIG. 8, and the transfers designated by 924 and 934 translate into the interlocking crossover 814 of FIG. 8.

With further reference to FIG. 9, a row 950 designates stitches for a first binder strand portion 952, which corresponds to the first binder strand portion 852 of FIG. 8, a row 960 designates stitches for a second binder strand portion 962, which corresponds to the second binder strand portion 862 of FIG. 8, and a row 970 designates stitches for a third binder strand portion 972, which correspond to the third binder strand portion 872 of FIG. 8. In FIG. 9, throughout the second knit zone 901B (i.e., columns A-H), the row 950 sequentially designates that the first binder strand portion 952 forms a tuck binder stitch 942A on the back side, floats two stitch positions (i.e., B and C), forms a tuck binder stitch 944D on the front side, forms a tuck binder stitch 942E on the back side, floats two stitch positions (i.e., F and G), and then forms a tuck binder stitch 944H. This pattern changes once the first binder strand portion 952 transitions into the first knit zone 901A (i.e., columns J-P), and as depicted, at a start of the first knit zone 902A, the first binder strand portion 952 forms a tuck binder stitch 942I on the back side and then forms a tuck binder stitch 944J on the front side. The first binder strand portion 952 then continues to form a tuck binder stitch at every other front stitch position and every other back stitch position through the rest of the first knit zone 901A.

As is also depicted in FIG. 9, the row 960 sequentially designates that the second binder strand portion 962 forms a tuck binder stitch 944B on the front side, forms a tuck binder stitch 942C on the back side, floats two stitch positions, forms a tuck binder stitch 944E on the front side, forms a tuck binder stitch 942H on the back side, floats one stitch position, and then terminates at a transition point between the first and second knit zones 901A, 901B. As such, the second binder strand portion 962 is knit in the second knit zone 901B but not the first knit zone 901A. Continuing, the row 970 sequentially designates that the third binder strand portion 972 forms a tuck binder stitch 944A on the front side, forms a tuck binder stitch 942B on the back side, and continues to form a tuck binder stitch at every other front stitch position and every other back stitch position throughout the second knit zone 901B. Then, at the transition point between the first and second knit zones 901A, 901B, the third binder strand portion 972 terminates, and thus, the third binder strand portion 972 is knit in the second knit zone 901B but not the first knit zone 901A. Accordingly, the combination of the stitches prescribed by the rows 920C, 930C, 950, 960, and 970 translate to the front-side course 822, the back-side course 832, the first tuck binder course 850, the second tuck binder course 860, and the third tuck binder course 870 of FIG. 8.

Previously described portions of this disclosure related to FIGS. 4-9 describe various knit structures that might construct the knit-textile regions 64, 66, 68 depicted in FIGS. 1-3. As previously described, these knit structures provide an amount of flexural rigidity and elongation to the knit-textile regions 64, 66, 68 based on, at least in part, the density of tuck binder stitches and interlocking crossovers, the yarn composition, the yarn size, the stitch length, and/or any combination thereof. Accordingly, in an aspect of the disclosure, the amount of flexural rigidity and elongation translates to a modulus of elasticity that provides an amount of support and compression to an underlying tissue (e.g., breast tissue). As such, a size of the knit-textile regions 64, 66, 68 may be configured to include a portion of, or all of, the breast-covering portions 30, 32, and the size may be determined in various manners, some of which may relate to a size of the upper-torso garment, the breast-covering portions, or a combination thereof. A modulus of elasticity may be determined in various manners, and in one aspect, a testing methodology specified by ASTM D 4964-96 may be used.

As described in other parts of this disclosure, a number of tuck binder stitches and interlocking crossovers in a course or in a knit-textile region can be increased or decreased to change the elongation and the stiffness properties (e.g., modulus of elasticity, flexural rigidity). As such, an aspect of the present disclosure includes an upper-torso garment that includes a first knit zone having a first modulus of elasticity and a second knit zone having a second modulus of elasticity, which is greater than the first modulus of elasticity.

Figure 10:
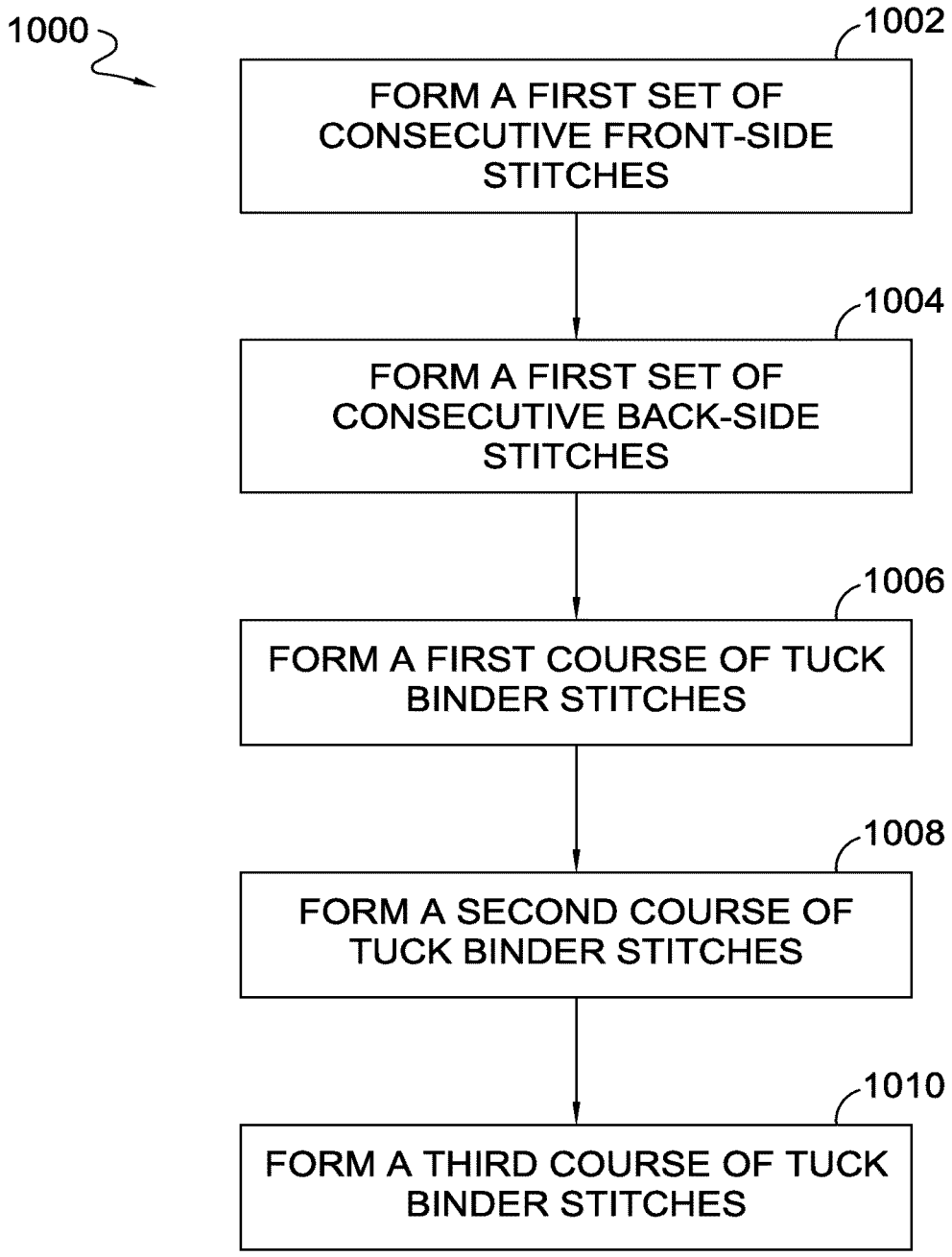
FIG. 10 depicts a flow diagram for a method of knitting an upper-torso garment having a tubular-jacquard knit structure having a varied interlocking tuck binder at different knit zones in accordance with an aspect of this disclosure.

In a further aspect of the present disclosure, an upper-torso garment having one or more of the aspects described herein may be knitted using a method represented by a flow diagram 1000 depicted in FIG. 10. Generally, a method of knitting an upper-torso garment includes the steps described at each individual block of the flow diagram 1000, which may be performed using a flat-bed knitting machine, having a front needle bed and a back needle bed, such as a commercially available V-bed knitting machine. Moreover, knitting machines having various bed gauges may be used, and in some aspects, various size needles and beds may be used such as 14 gauge, 16 gauge, 18 gauge, and the like.

With reference to FIG. 10, a block 1002 includes forming a first set of consecutive front-side stitches at a first quantity of front-bed needles. In one aspect, the first quantity of front-bed needles includes a first end front-bed needle, a second end front-bed needle, and a first plurality of front-bed needles between the first end front-bed needle and the second end front-bed needle. Next, a block 1004 includes forming a first set of consecutive back-side stitches at a first quantity of back-bed needles, and in some aspects, the first quantity of back-bed needles includes a first end back-bed needle, a second end back-bed needle, and a first plurality of back-bed needles between the first end back-bed needle and the second end back-bed needle. After forming the first sets of consecutive front-side and back-side stitches, courses of tuck binder stitches are formed. As such, a block 1006 includes forming a first course of tuck binder stitches by moving a carriage in a first direction, a block 1008 includes forming a second course of tuck binder stitches by changing a direction of the carriage and by moving the carriage in a second direction, and a block 1010 includes forming a third course of tuck binder stitches by changing the direction of the carriage and by moving the carriage in the first direction.

In other aspects, the method of knitting the upper-torso garment may include additional steps such as forming a second set of consecutive front-side stitches at a second quantity of front-bed needles, forming a second set of consecutive back-side stitches at a second quantity of back-bed needles, and forming a fourth course of tuck binder stitches that cross back and forth between the second set of consecutive front-side stitches and the second set of consecutive back-side stitches by moving the carriage in the first direction. In another aspect, the method of knitting the upper-torso garment may include forming interlocking crossovers by transferring a yarn strand that forms a set of consecutive front-side stitches to a back-bed needle position and simultaneously transferring a yarn strand that forms a set of consecutive front-side stitches to a front-bed needle position.

The entire upper-torso garment may be knit as a single integrated piece, which is then coupled together at particular locations to create a left side, right side, anterior portion, and posterior portion. In addition, certain parts of the upper-torso garment may be knit separately from one another and then coupled to form the upper-torso garment. In one aspect, the anterior portion with straps is constructed separately from the posterior portion and the two pieces are then coupled to form the upper-torso garment. For example, at least part of the anterior portion may be constructed with all non-elastic yarns, whereas elastic yarns may be knit into the posterior portion. The anterior portion may then be coupled to the posterior portion. These manufacturing aspects are merely examples, and aspects herein contemplate that various other techniques may also be utilized.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. An upper-torso garment comprising:

a first knit zone and a second knit zone, the first knit zone comprising a single course of tuck binder stitches that cross back and forth between a first set of front-side stitches organized into a first set of front-side courses, and a first set of back-side stitches organized into a first set of back-side courses, wherein each course in the first set of front-side courses is connected to a course in the first set of back-side courses by the single course of tuck binder stitches; and the second knit zone comprising a plurality of courses of tuck binder stitches that cross back and forth between a second set of front-side stitches organized into a second set of front-side courses, and a second set of back-side stitches organized into a second set of back-side courses, wherein each course in the second set of front-side courses is connected to a course in the second set of back-side courses by the plurality of courses of tuck binder stitches.

Clause 2. The upper-torso garment of clause 1, wherein the first set of front-side courses, the first set of back-side courses, and the single course of tuck binder stitches are constructed of a first non-elastic yarn.

Clause 3. The upper-torso garment of any of the preceding clauses, wherein the plurality of courses of tuck binder stitches, the second set of front-side courses, and the second set of back-side courses are constructed of a second non-elastic yarn.

Clause 4. The upper-torso garment of any of the preceding clauses, wherein the first non-elastic yarn and the second non-elastic yarn include a same yarn type having a same yarn composition and a same yarn size.

Clause 5. The upper-torso garment of any of the preceding clauses, wherein the first knit zone has a first modulus of elasticity, and wherein the second knit zone has a second modulus of elasticity, which is greater than the first modulus of elasticity.

Clause 6. The upper-torso garment of any of the preceding clauses, wherein the second knit zone comprises an underarm portion of the upper-torso garment.

Clause 7. The upper-torso garment of any of the preceding clauses, wherein the first knit zone comprises a breast-covering portion of the upper-torso garment.

Clause 8. The upper-torso garment of any of the preceding clauses, wherein the second knit zone comprises one or more encapsulation portions that form a perimeter around at least part of the breast-covering portion.

Clause 9. The upper-torso garment of any of the preceding clauses, wherein the first knit zone is integrally knit with the second knit zone in the upper-torso garment.

Clause 10. An upper-torso garment comprising:

a first dual-layer knit zone and a second dual-layer knit zone, the first dual-layer knit zone having a same quantity of front and back wales, and the second dual-layer knit zone having a same quantity of front and back wales;

the first dual-layer knit zone comprising a first set of front-side courses, a first set of back-side courses, and a first set of tuck binder courses, wherein each tuck binder course of the first set of tuck binder courses crosses back and forth between a front-side course in the first set of front-side courses and a back-side course in the first set of back-side courses, wherein the first set of tuck binder courses comprises a first quantity of tuck binder stitches; and the second dual-layer knit zone comprising a second set of front-side courses, a second set of back-side courses, and a second set of tuck binder courses, wherein each tuck binder course of the second set of tuck binder courses crosses back and forth between a front-side course in the second set of front-side courses and a back-side course in the second set of back-side courses, wherein the second set of tuck binder courses includes a second quantity of tuck binder stitches that is greater than the first quantity of tuck binder stitches.

Clause 11. The upper-torso garment of clause 10, wherein each course in the first set of tuck binder courses includes a tuck binder stitch at every third stitch position of the front-side course and at every third stitch position of the back-side course.

Clause 12. The upper-torso garment of any of the preceding clauses, wherein each course in the second set of tuck binder courses includes a tuck binder stitch at every second stitch position and every third stitch position of the front-side course and at every second stitch position and every third stitch position of the back-side course.

Clause 13. The upper-torso garment of any of the preceding clauses, wherein each course in the second set of tuck binder courses includes a tuck binder stitch at every stitch position of the front-side course and at every stitch position of the back-side course.

Clause 14. The upper-torso garment of any of the preceding clauses, wherein the first dual-layer knit zone is constructed from a first non-elastic yarn, and wherein the second dual-layer knit zone is constructed from a second non-elastic yarn.

Clause 15. The upper-torso garment of any of the preceding clauses, wherein the first dual-layer knit zone comprises a breast-covering portion of the upper-torso garment, an encapsulation portion forming a perimeter around at least a part of the breast-covering portion, or a combination thereof, and wherein the second dual-layer knit zone comprises an underarm portion of the upper-torso garment.

Clause 16. The upper-torso garment of any of the preceding clauses, wherein the first dual-layer knit zone and the second dual-layer knit zone are positioned adjacent in the upper-torso garment and wherein the first dual-layer knit zone is integrally knit with the second dual-layer knit zone in the upper-torso garment.

Clause 17. A method of knitting an upper-torso garment comprising:

forming a first set of consecutive front-side stitches at a first quantity of front-bed needles, which includes a first end front-bed needle, a second end front-bed needle, and a first plurality of front-bed needles between the first end front-bed needle and the second end front-bed needle;

forming a first set of consecutive back-side stitches at a first quantity of back-bed needles, which includes a first end back-bed needle, a second end back-bed needle, and a first plurality of back-bed needles between the first end back-bed needle and the second end back-bed needle;

forming a first course of tuck binder stitches that cross back and forth between the first set of consecutive front-side stitches and the first set of consecutive back-side stitches by moving a carriage in a first direction towards the first end front-bed needle and the first end back-bed needle;

forming a second course of tuck binder stitches by changing a direction of the carriage before the carriage reaches the first end front-bed needle and the first end back-bed needle and by moving the carriage in a second direction towards the second end front-bed needle and the second end back-bed needle; and forming a third course of tuck binder stitches by changing the direction of the carriage before the carriage reaches the second end front-bed needle and the second end back-bed needle and by moving the carriage in the first direction.

Clause 18. The method of knitting an upper-torso garment of clause 17, further comprising:

forming a second set of consecutive front-side stitches at a second quantity of front-bed needles, which includes a third end front-bed needle, a fourth end front-bed needle, and a second plurality of front-bed needles between the third end front-bed needle and the fourth end front-bed needle;

forming a second set of consecutive back-side stitches at a second quantity of back-bed needles, which includes a third end back-bed needle, a fourth end back-bed needle, and a second plurality of back-bed needles between the third end back-bed needle and the fourth end back-bed needle; and forming a fourth course of tuck binder stitches that cross back and forth between the second set of consecutive front-side stitches and the second set of consecutive back-side stitches by moving the carriage in the first direction, which is towards the third end front-bed needle and the third end back-bed needle.

Clause 19. The method of knitting an upper-torso garment of any of the preceding clauses, wherein the first course of tuck binder stitches is offset from the second course of tuck binder stitches and is further offset from the third course of tuck binder stitches in a first portion of the first quantity of front-bed needles and the first quantity of back-bed needles to form a first knit zone in the upper-torso garment, and wherein the first course of tuck binder stitches, the second course of tuck binder stitches, and the third course of tuck binder stitches overlap in a second portion of the first quantity of front-bed needles and the first quantity of back-bed needles that is different than the first portion to form a second knit zone in the upper-torso garment.

Clause 20. The method of knitting an upper-torso garment of any of the preceding clauses, wherein the first knit zone comprises a breast-covering portion of the upper-torso garment, and wherein the second knit zone comprises an underarm portion of the upper-torso garment, an encapsulation portion forming a perimeter around at least part of the breast-covering portion, or a combination thereof From the foregoing, it will be seen that this subject matter is adapted to attain ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible variations and alternatives may be made of the subject matter without departing from the scope thereof, it is to be understood that all matter herein set forth or shown in the accompanying drawings is to be interpreted as illustrative and not in a limiting sense.

The invention claimed is:

1. A method of knitting an upper-torso garment comprising:

forming a first set of front-side stitches organized into a first set of front-side courses;

forming a first set of back-side stitches organized into a first set of back-side courses;

forming a first knit zone comprising a single tuck binder course of tuck binder stitches connecting the first set of front-side courses to the first set of back-side courses, the first knit zone forming a first breast-covering portion and a second breast-covering portion of the upper-torso garment having a first modulus of elasticity;

forming a second set of front-side stitches organized into a second set of front-side courses;

forming a second set of back-side stitches organized into a second set of back-side courses; and forming a second knit zone by knitting a plurality of tuck binder courses of tuck binder stitches connecting the second set of front-side courses to the second set of back-side courses, the second knit zone forming an underarm portion of the upper-torso garment having a second modulus of elasticity greater than the first modulus of elasticity.

2. The method of claim 1, wherein the first set of front-side courses, the first set of back-side courses, and the single course of tuck binder stitches are constructed of a first non-elastic yarn.

3. The method of claim 2, wherein the second set of front-side courses, the second set of back-side courses, and the plurality of courses of tuck binder stitches are constructed of a second non-elastic yarn.

4. The method of claim 3, wherein the first non-elastic yarn and the second non-elastic yarn include a same yarn type having a same yarn composition and a same yarn size.

5. The method of claim 1, wherein the first knit zone is integrally knit with the second knit zone in the upper-torso garment.

6. The method of claim 1, wherein the second knit zone forming an underarm portion of the upper-torso garment comprises a first underarm portion and a second underarm portion of the upper-torso garment, an encapsulation portion forming a perimeter around at least part of the breast-covering portion, or a combination thereof.

7. The method of claim 1, wherein the first knit zone comprises a single tuck binder course at every other front-side stitch and every other back-side stitch.

8. The method of claim 1, wherein the knitting is performed using a flat-bed knitting machine, having a front needle bed and a back needle bed.

9. A method comprising:

knitting a breast-covering portion of an upper-torso garment, the breast-covering portion comprising a first modulus of elasticity based on a first stitch density associated with a first tuck binder wherein the first stitch density associated with the first tuck binder is one tuck binder stitch at every third stitch position;

knitting a second portion of the upper-torso garment; and increasing, by increasing a second stitch density associated with a second tuck binder, a second modulus of elasticity associated with the second portion.

10. The method of claim 9, wherein knitting the breast-covering portion includes knitting first front courses, knitting first back courses, and connecting the first front courses and the first back courses with the first tuck binder.

11. The method of claim 10, wherein knitting the second portion includes knitting second front courses integral with the first front courses, knitting second back courses integral with the first back courses, and connecting the second front courses and the second back courses with the second tuck binder.

12. The method of claim 9, wherein the second portion is an underarm portion of the upper-torso garment.

13. The method of claim 9, wherein the second portion is one or more encapsulation portions that form a perimeter around at least part of the breast-covering portion of the upper-torso garment.

14. The method of claim 9, wherein knitting the second portion comprises moving a carriage back and forth in opposite directions to knit different courses of tuck binder.

15. The method of claim 9 further comprising, knitting a third portion of the upper-torso garment, the third portion comprising, based on a third stitch density associated with a third tuck binder, a third modulus of elasticity, which is different from the first modulus of elasticity and the second modulus of elasticity.

16. The method of claim 9, wherein knitting the breast-covering portion and the second portion comprises knitting front courses and back courses in a tubular-jacquard structure.

17. The method of claim 16, wherein the tubular-jacquard structure comprises interlocking crossovers between the front courses and the back courses.

18. The method of claim 9, wherein the first tuck binder and the second tuck binder comprise a non-elastic yarn.

* * * * *